United States Patent [19]

Wilson et al.

[11] 4,158,968

[45] Jun. 26, 1979

[54] HAND CONTROL SYSTEM FOR A TRACTOR

[75] Inventors: Charles D. Wilson; Gary L. Cochran; Maurice Klee, all of Burlington, Iowa

[73] Assignee: J. I. Case Company, Racine, Wis.

[21] Appl. No.: 855,013

[22] Filed: Nov. 25, 1977

[51] Int. Cl.[2] ..... G05G 9/04

[52] U.S. Cl. ..... 74/471 R; 74/491; 180/6.2; 180/77 R; 180/77 H; 180/77 HT; 192/4 A

[58] Field of Search ..... 74/471 R, 491; 180/77 R, 77 H, 77 HT, 6.2; 192/4 A

[56] References Cited

U.S. PATENT DOCUMENTS

| | | | |
|---|---|---|---|
| 2,480,521 | 8/1949 | Thompson | 74/471 |
| 2,877,660 | 3/1959 | Rush | 74/471 R |

FOREIGN PATENT DOCUMENTS

| | | | |
|---|---|---|---|
| 535619 | 11/1955 | France | 180/77 H |
| 16716 of | 1897 | United Kingdom | 180/77 HT |
| 525224 | 8/1940 | United Kingdom | 180/77 HT |

*Primary Examiner*—Allan D. Herrmann
*Attorney, Agent, or Firm*—Arthur J. Hansmann

[57] ABSTRACT

A hand control system for a tractor having several controllable units such as hydraulic and brake units. A tubular member is rotatably mounted about its longitudinal axis and it connects to one of the units for actuating the same, and a member is pivotally mounted on the tubular member and has a handle thereon which connects to a linkage extending partly through the tubular member and connects to another of the units for operating same. The tubular member can be rotated to actuate its connected unit, without requiring actuation of the handle, and, conversely, the handle can be actuated to move its linkage and actuate its connected unit, without moving the tubular member and its unit. Also, another tractor unit, such as a brake, is connected into the system such that when the one member is pivoted upwardly on the tubular member the handle is placed in an inoperative position and the brake is automatically operated, as desired.

7 Claims, 5 Drawing Figures

HAND CONTROL SYSTEM FOR A TRACTOR

This invention relates to a hand control system for a tractor, and, more particularly, it relates to a system of a mechanism for individually controlling the several powered units in a tractor, such as hydraulic units and a brake, all through a single hand control for the system.

BACKGROUND OF THE INVENTION

The prior tractor art is already aware of various arrangements for hand controls for the powered units commonly mounted on and employed in a tractor. These units include hydraulic elements, such as transmissions and valves for actuating parts on the tractor and including a brake. Further, the prior art units of which this invention is concerned are of the tractor environmental type and including the so-called skid steer type of loaders which require special levers and linkages for operating the hydraulic valve spools and the hydrostatic transmission pumps. Traditionally, the prior art has achieved its functions with the use of levers attached to a cross-shaft with handles attached to the other ends of the levers, all for operating the transmission and a hydraulic valve, for instance.

One of the problems with regard to the prior art is the fact that the tractor or loaders inherently have a limited space for the operator's compartment, and thus the projecting handles and levers are usually occupying valuable space which is required for movement of the operator into and out of the operator's compartment. In some respects, the prior art handles and levers must necessarily be arranged, due to their particular shape and system structure, so that they project into the path which the operator would normally move along in getting into and out of the operator's compartment. As such, the operator could accidentally bump these handles and move them to undesirable positions at that particular moment. Still further, the prior art control systems are of a limited nature in that they control only some of the powered units mentioned, and one handle usually is not capable of controlling all of the powered units, such as hereinafter described with regard to this invention.

Accordingly, it is an objective of this invention to improve upon the prior art control systems, and, more specifically, the present invention provides a single handle control system which operates the several powered units including the transmission, hydraulic valve, and the brake.

One specific object and advantage of this invention is to provide a control system for a tractor having powered units to be operated, and wherein the system controls several units by means of a single handle and different directions of maneuvering the single handle and wherein the handle portion of the control system can be moved to an inoperative and thus safe position where the system cannot inadvertently be operated and wherein the projecting portions of the system are out of the way of the operator who can thus freely move into and out of the operator's compartment. In accomplishing the aforementioned objects and advantages, the present invention provides a control system which is reliable in its function and which is sensitive so that all movements in the several directions create operation of the powered units attached to the system, and yet there are only a minimum of parts which are easily maneuvered and are sturdy and reliable in their function.

Even more specifically, the present invention provides a control system for operating the transmission of a tractor, such as a skid type of tractor which has separate power control of the left and right wheels on the tractor and thus two control handles are utilized and the movements thereof are in the horizontal plane which results in less operator fatigue and which permits a more natural movement and which also provides for greater variations in the design of the operator's compartment and the arrangement of other structural parts therein.

Other objects and advantages will become apparent upon reading the following description in light of the accompanying drawings.

DETAILED DESCRIPTION OF THE PREFERRED EMBODIMENT

Figures 1, 2, 3, 4, 5:
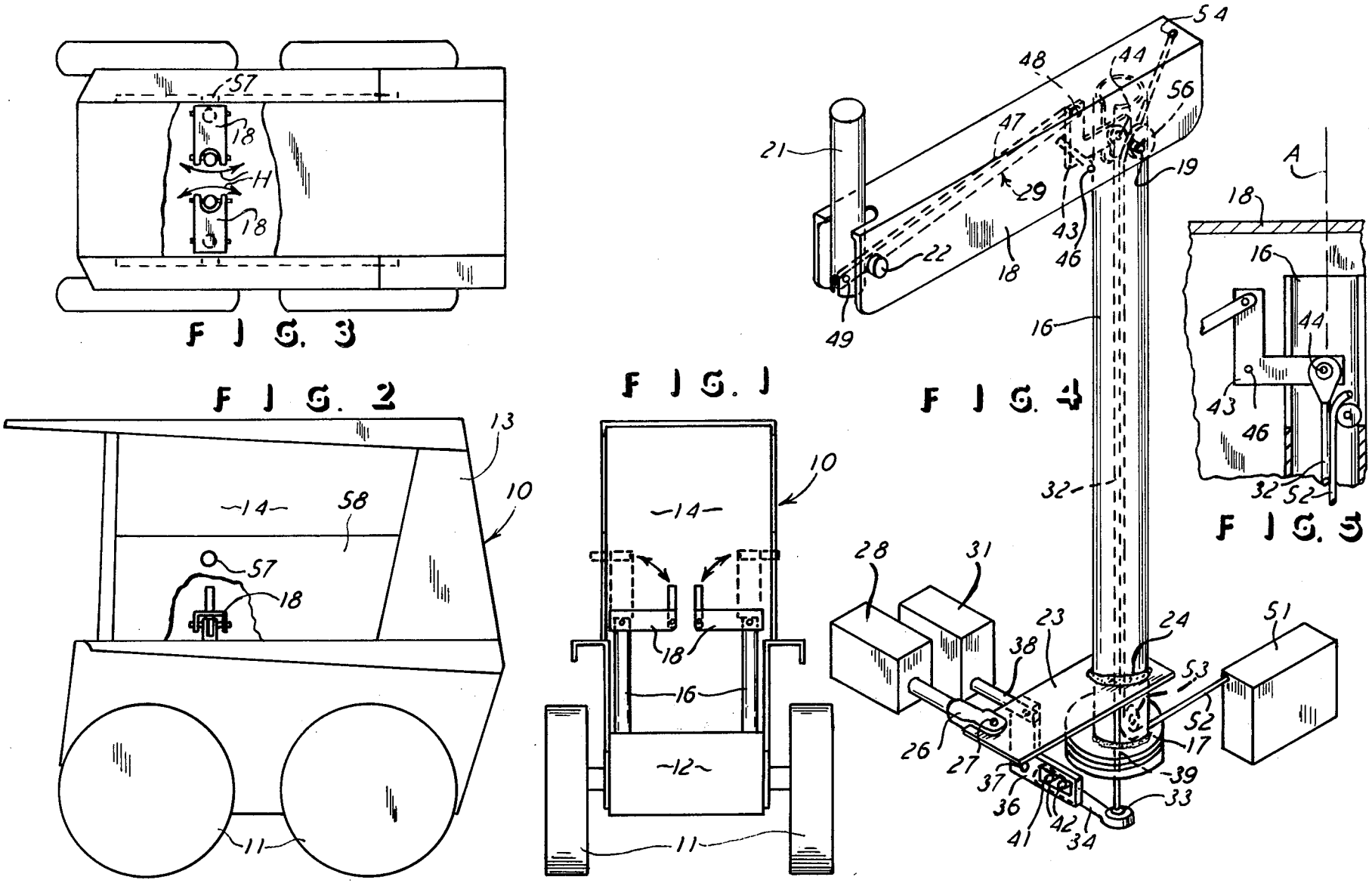
FIGS. 1, 2, and 3 are front, side, and top views, respectively, of a tractor having the control system of this invention.
FIG. 4 is an enlarged perspective view of the control system incorporated in the aforementioned three views.
FIG. 5 is an enlarged side elevational view of a fragment of the control system of this invention, particularly as seen in FIG. 4.

FIGS. 1, 2, and 3 show a tractor, generally designated 10, having ground wheels 11, a frame or chassis 12, and an upper structure 13 which defines an operator's compartment located at the designation 14. It will be further understood by one skilled in the art that the tractor 10 may be of the skid loader type which is steered and powered by means of separately powering the two left wheels with respect to the two right wheels. That is, with the two left wheels shown in FIG. 2, there may be driving power applied to those wheels rather than to the two right wheels 11, and thereby the tractor 10 would turn to the right. The opposite action would of course create a left turn; and all four wheels may have means for applying brakes thereto. All of that would be as understood by anyone skilled in the art and with regard to a conventional type of skid loader or any tractor which has wheels on one side powered and braked separate from the wheels on the other side, as mentioned.

The control system of this invention includes the uprightly disposed tubular member 16 which is suitably rotatably mounted in a rotatable support 17 which may be supported on the tractor 10 in any commonly known or conventional arrangement. The member 16 is shown to be cylindrically shaped, and a channel member 18 is pivotally attached to the upper end of the tubular member 16 by means of a pivot pin 19, and the channel member 18 extends transverse to the longitudinal axis of the tubular member 16, and that axis is of course in the vertical direction as shown in the drawings and particularly in FIG. 4, and it is shown by the line designated A in FIG. 5. The member 18 extends to one side of the tubular member 16, and a hand grip or handle 21 is pivotally mounted on the extending end of the member 18 by means of a pivot pin 22 which through the member 18 and the lower end of the hand grip or handle 21.

The lower end of the tubular member 16 has an arm in the form of a plate 23 affixed thereto such as by means of welding at 24, and the arm 23 extends transverse to the tubular member 16 and a link 26 is pivoted thereto by means of a pin 27. The arm 23 and link 26 thus form an articulated connection to a transmission control 28 which may be in the form of a hydraulic unit or valve and which is somewhat diagrammatically shown in FIG. 4.

With the structure as mentioned in the foregoing, movement of the handle 21 in a horizontal plane will cause corresponding rotation of the tubular member 16 and corresponding pivotal movement of the arm 23 and thus displacement of the link 26 and consequent operation of the powered unit 28. Therefore, the structure of the control system described up to this point provides for rotation of the member 16 and the operation of the so-called first powered unit 28 which may be a unit for controlling the transmission of the tractor and thus the drive to the wheels on either the left or right side of the tractor. That is, the drawings show that there are two sets of the control units, with one set actually shown in FIG. 4 for controlling one side of the tractor. FIG. 3 shows the two sets of the control units, each of which includes the complete system as shown and described in connection with FIG. 4, and it will be further seen that the arrows H in FIG. 3 indicate the movement of the heretofore described movable parts in the horizontal plane of movement, predominantly the swinging of the handle 21 and the transversely-extending arm 18, all relative to the axis A of the member 16.

Another aspect of each of the two control systems being described and shown herein is the inclusion of a linkage designated 29 and extending from the hand grip or handle 21 and down to a second powered unit 31. Thus the linkage 29 has a plurality of links with one link 32 thereof extending along the axis A of the tubular member 16, and the link 32 is movable along the axis A and is rotatable on the axis A, along with the rotation of the member 16. The lower end of the link 32 has a swivel joint or connector 33 joining it with an arm 34 extending to a right angled lever 36 which is pivotally mounted on a fixed pin 37 suitably supported on the tractor 10. The arrangement is such that the up-and-down movement of the link 32, that is along the axis A of the member 16, causes pivotal movement of the lever 36 which in turn is pinned to an arm 38 connecting to the powered unit 31 which may be a hydraulic valve utilized in the operation of the tractor. The arrangement is such that the rod or link 32 is confined to movement along the axis A, by means of an opening restriction in the rotatable support 17 sufficient only to snugly accommodate the rod or link 32 at its lower end and as indicated at 39. Therefore, up-and-down movement of the rod 32 will cause up-and-down movement of the link 34 and corresponding up-and-down movement of the lever 36 which is shown slidably pinned to the link 34 by means of an elongated slot 41 in the lever 36 and the two spaced-apart pins 42 slidably received in the slot 41 and extending from the arm 34. Therefore, the arm 34 can slide slightly along the lever 36, but the up-and-down movement of the arm 34 will be transmitted to the lever 36, all for moving the actuation rod 38 in and out relative to the powered unit 31 for operating the powered unit 31, as desired.

The remainder of the linkage 29 is shown to consist of another right angle lever 43 which is pivotally pinned to the upper end of the link 32 by means of the pin 44 and which is pivoted on the member 18 by the pivot pin 46. Also, the lever 43 is pivotally connected with a link 47 by means of a pin 48, and the link 47 is also pivoted to the handle 21 by a pin 49.

The entire arrangement of the linkage 29 is such that movement of the handle 21 about its pivot pin 22 and thus in the vertical plane will cause longitudinal displacement of the link 47 and pivotal action of the lever 43 about its mounting pin 46 and that will induce longitudinal movement of the link 32 and the consequent operation of the powered unit 31, as mentioned. Further, by virtue of the swivel or ball joint 33 at the lower end of the link 32, the tubular member 16 can rotate by means of the movement of the handle 21 and the member 18 in the horizontal plane, and that rotation will of course provide the action in the powered unit 28 but it will not be transmitted to the link or rod 32 which will simply rotate since it is on the axis A of the tubular member 16 and the ball joint 33 permits the rod or link 32 to rotate as mentioned. Therefore, either one of the powered units 28 or 31 can be actuated independently of the other, and there can also be a simultaneous actuation by a compound type movement for the handle 21, that is both in the horizontal and vertical or pivoting direction so that the member 16 is rotated at the same time that the link 32 is displaced along the axis of the member 16, all as described above.

Still a third feature of the control system is with regard to controlling another powered unit designated 51, and that can be the wheel brakes for the left or right side wheels 11. A brake cable 52 extends from the brake unit 51 and around a pulley 53 and upwardly and at least substantially along the axis A of the tubular member 16 and up to a fixed connector 54 on the channel member 18. A pulley 56 is mounted on the channel member 18, and the cable 52 extends over the pulley 56 to direct the cable 52 substantially along the axis A of the member 16. Of course the point of the location for the fastener or attachment member 54 is offset relative to the axis A, such that when the member 18 is pivoted about its pivot pin 19, there will be movement of the cable 52 along its length, and it will be understood that the cable 52 is under a pulling action or a spring pulling tension so that the cable is constantly being pulled inwardly into the unit 51, but of course the pulling force is not sufficient to overcome the static friction or any other holding force of the member 18 in its position shown in FIG. 4 and in solid lines in FIGS. 1, 2, and 3. However, when the operator pulls upwardly on the hand grip 21 and thus pivots the member 18 about its pin 19, and that would be to the dotted position shown in FIG. 1, then the cable 52 is permitted to more completely enter the brake unit 51 and thus the vehicle brakes will be applied in that action. Therefore, the third powered unit 51 is also conytrolled by this control system in the manner mentioned, namely, the upward pivoting of the member 18.

Further, when the hand grip 21 and member 18 are pivoted upwardly to the dotted position shown in FIG. 1, then the control system is placed in a vehicle brake-action position and into the inoperative position for control of the other units 28 and 31. Such inoperative position is achieved by means of having the hand grip 21 enter a lock arrangement provided by a retainer or opening 57 in the side wall or member 58 of the tractor 10, such as seen in FIGS. 2 and 3. Of course with the hand grip 21 in the retainer 57, the member 16 cannot be rotated, and the member 18 will not be moved in the vertical plane and back to its full-line position shown in the drawings, at least not without intentional and direct action on the part of the vehicle operator, and therefore there can be no inadvertent movement or bumping of the control system when it is in the safe or stored position.

Still further, FIG. 1 shows that when the member 18 is swung to the stored position, that is when the hand grips 21 are in the storage compartments 57, then there is full clearance for the operator to move inside the cab or body 13. Of course the member 18 moves in the plane coincident with the axis A of the member 16 when the member 18 is moved to the stored position and when actuating the brake unit 51. Of course only the action of pivoting the handle or hand grip 21 about its pivot pin 22 will cause the longitudinal movement of the link 32, and the up-and-down swinging of the member 18 will not cause longitudinal movement of the link 32 since the link 32 has its upper end connected with the pivot pin 44 which is co-axial with the pivot pin 19. Therefore, swinging of the member 18 in any upright plane coincident with the axis A will not displace the pivot pin 44 and thus will not move the link 32 and will therefore not actuate the transmission through the powered unit 28.

In summary, the link 32 and the cable 52 extend substantially along the axis of the tubular member 16 and thus the only action which induces longitudinal movement of the link 32 and the cable 52 is, respectively, the pivoting of the handle 21 about its pivot pin 22 and the pivoting of the member 18 about its pivot pin 19, and those movements are mutually exclusive of movement of the other one of the link 32 and cable 52. Further, swinging of the member 18 about the longitudinal axis A of the tubular member 16 will cause rotation of the member 16 and the consequent operation of the powered unit 28.

What we claim is:

1. A hand control system for a tractor comprising several controllable units, a first member rotatably mounted about an axis thereof and being operatively connected with a first one of said units for transmitting movement to said one unit in response to rotation of said first member, a linkage mounted on said first member and having a plurality of links with one of said links being operatively connected to a second one of said units and extending and movable along said axis of said first member and with another of said links being pivotally connected to said one of said links on said axis and extending therefrom oblique to said axis for movement of said another of said links in a plane co-incident with said axis to induce movement of said one of said links along said axis, a second member pivotally mounted on said first member and being pivotal thereon in a plane co-incident with and offset from said axis and on the axis of pivotal connection of said links and for transmitting rotation force to said first member, whereby pivotal movement of said second member induces movement of said one of said links along said axis of said first member for operating said second one of said units, and whereby movement of said second member oblique to said planes is free of inducing the axial movement of said one of said links and instead induces rotation of said first member for operating said first one unit, and a hand grip pivotal on said second member and being connected with said linkage, for articulation of said linkage and rotation of said first member.

2. The hand control system for a tractor as claimed in claim 1, wherein said first member is a hollow tube member and said one of said links extends therein.

3. The hand control system for a tractor as claimed in claim 1, wherein said second member extends oblique to said axis of said first member and presents a torque arm for rotating said first member.

4. The hand control system for a tractor as claimed in claim 1, wherein said another of said links is pivotally pinned on said second member, and said linkage including additional links.

5. The hand control system for a tractor as claimed in claim 1, including a swivel joint interconnected between said one of said links and said second one of said units for the rotation of said first member and corresponding free rotation of said one of said links.

6. The hand control system for a tractor as claimed in claim 1, including a connector attached to said second member for actuation in response to pivotal movement of said second member, and said connector being operatively connected to a third one of said units for operating said third one of said units in response to pivoting of said second member.

7. The hand control system for a tractor as claimed in claim 6, including a storage compartment disposed adjacent said second member for receiving said hand grip when said second member is pivoted, to thereby preclude rotation of said first member and consequently render said first and said second units temporarily inoperative.

* * * * *